US005109893A

United States Patent [19]

Derby

[11] Patent Number: 5,109,893

[45] Date of Patent: May 5, 1992

[54] VACUUM FILL SYSTEM

[75] Inventor: Norwin C. Derby, Sherman, Tex.

[73] Assignee: B.A.G. Corporation, Dallas, Tex.

[21] Appl. No.: 615,293

[22] Filed: Nov. 19, 1990

Related U.S. Application Data

[63] Continuation-in-part of Ser. No. 558,678, Jul. 27, 1990, which is a continuation-in-part of Ser. No. 407,901, Sep. 15, 1989, abandoned.

[51] Int. Cl.[5] ..... B65B 1/26

[52] U.S. Cl. ..... 141/67; 141/10; 141/68; 141/71; 141/51; 222/368; 414/220

[58] Field of Search ..... 141/5, 7, 8, 10–12, 141/67, 68, 71, 73, 80, 51, 59, 61, 4, 43, 48, 50, 57; 222/450, 442, 445, 447, 394, 637, 368; 414/220, 219

[56] References Cited

U.S. PATENT DOCUMENTS

| | | | |
|---|---|---|---|
| 2,138,356 | 11/1938 | Ryan et al. . | |
| 2,142,990 | 1/1939 | Belcher . | |
| 2,489,925 | 11/1949 | Onwake | 414/217 X |
| 2,688,416 | 9/1954 | Skretting | 414/220 |
| 2,760,702 | 8/1956 | Pechy | 141/51 X |
| 2,780,247 | 2/1957 | Claasen, Jr. | 141/7 |
| 2,783,786 | 3/1957 | Carter . | |
| 3,101,853 | 8/1963 | Long et al. | 222/368 X |
| 3,260,285 | 7/1966 | Vogt | 141/8 |
| 3,586,066 | 6/1971 | Brown . | |
| 3,589,411 | 6/1971 | Vogt | 141/71 |
| 3,656,518 | 4/1972 | Aronson | 141/67 X |
| 3,785,410 | 1/1974 | Carter . | |
| 3,788,368 | 1/1974 | Geng et al. | 141/67 |
| 3,847,191 | 11/1974 | Aronson | 141/12 |
| 4,185,669 | 1/1980 | Jevakohoff . | |
| 4,397,657 | 8/1983 | Selep et al. | 414/220 X |
| 4,457,125 | 7/1984 | Fishburne . | |

FOREIGN PATENT DOCUMENTS

| | | |
|---|---|---|
| 1265286 | 5/1961 | France . |

*Primary Examiner*—Henry J. Recla
*Assistant Examiner*—Casey Jacyna
*Attorney, Agent, or Firm*—Michael A. O'Neil

[57] ABSTRACT

A vacuum fill system for deaerating flowable material includes a cylindrical container partitioned into a plurality of chambers which rotate sequentially and which are connected to a vacuum pump for establishing a vacuum when filled with flowable material. The flowable material deaerates and compacts when atmospheric pressure is subsequently restored.

12 Claims, 4 Drawing Sheets

VACUUM FILL SYSTEM

RELATED APPLICATIONS

This application is a continuation-in-part of copending U.S application Ser. No. 558,678, filed Jul. 27, 1990, still pending a continuation-in-part of copending U.S. application Ser. No. 407,901, filed Sept. 15, 1989 now abandoned.

TECHNICAL FIELD OF THE INVENTION

This invention relates to a vacuum fill system for deaerating flowable material for storage in a container, and in particular to a vacuum fill system for deaerating and compacting flowable material used in flexible bulk containers.

BACKGROUND OF THE INVENTION

Containers used in the storage, transportation and dispensation of flowable material have been around for as long as civilization itself. The use of such containers, however, has always been limited by (1) the weight, density and other physical properties of the material being stored and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year because of the misuse of storage space and container material. This has been particularly true in the storage, transportation and dispensation of flowable material in semi-bulk quantities such as grains, chemicals and other bulky substances stored in flexible bulk containers, such as those disclosed in U.S. Pat. Nos. 4,143,796 and 4,194,652.

It has long been known that the settling process is caused by the natural aeration of flowable material as the material is placed inside a container. As the container is shipped to its final destination, the air escapes from the aerated material causing the product to compact and reduce in volume. Thus, when the container is opened, the flowable material has settled to the bottom of the container, i.e. the bag of potato chips is only half full.

Any process or system, such as the present invention, for storing material in a container for shipment that allows all of the container to be filled with product and eliminates the excess air results in an enormous cost savings. Indeed, the shipment of smaller sized containers using vacuum-sealed packages such as, e.g., vacuum-sealed coffee containers, has alleviated many of the above problems of cost and time.

Although vacuum-sealed packaging has proved to be an efficient, cost-saving and consumer-pleasing method of shipping small quantities of goods, before now, it has been impossible to apply such techniques to other areas of storage, transportation and dispensation of flowable material. This ha been particularly true in the market for semi-bulk flowable material.

SUMMARY OF THE INVENTION

The present invention relates to a vacuum fill system for deaerating flowable material, and in particular to a vacuum fill system for use with flexible bulk containers used to store, transport and dispense flowable material i semi-bulk quantities.

The vacuum fill system of the present invention generally comprises a cylindrical container having a plurality of chambers; means for intermittently rotating the chambers; means for establishing a vacuum for deaerating the flowable material; and means for compacting the deaerated flowable material.

In the preferred embodiment of the invention, a cylindrical container encloses a rotating member which partitions the container into four chambers and sequentially positions the four chambers. Conventional vacuum pumps capable of pulling a vacuum of eighteen (18) inches of mercury for deaerating the flowable material are connected to two of the chambers through vacuum lines. Compressed air for ejecting the compacted, deaerated flowable material is connected to another chamber through an air line.

Operation of the vacuum fill system is simple and easy. A vacuum is established through the use of a conventional vacuum pump in empty chamber one. A geneva mechanism sequentially moves the chambers in a counterclockwise direction to a position where empty chamber one is aligned with an intake spout. Flowable material is poured from a holding/storage device into chamber one. When chamber one is full, the geneva mechanism repositions the chambers such that empty chamber two is aligned with the intake spout. While flowable material enters chamber two, a vacuum is established in chamber one through the use of a conventional vacuum pump. Simultaneously, a vacuum is created in empty chamber three.

After sufficient deaeration of the flowable material is achieved in chamber one, chamber two is filled with flowable material, and air is evacuated from empty chamber three, the geneva mechanism moves the chambers again. A vacuum is created in empty chamber four, flowable material is poured into chamber three, a vacuum is established in chamber two, and chamber one is aligned with the discharge spout.

When the vacuum is released in chamber one, the interior of chamber one is returned to atmospheric pressure substantially instantaneously, causing the deaerated flowable material to compact. The compacted, deaerated flowable material then drops from chamber one through the discharge spout into a flexible container. Compressed air may be used to eject the compacted, deaerated material.

After the compacted, deaerated flowable material drops from chamber one into the flexible container, a vacuum is created in chambers two and four, and flowable material fills chamber three, the geneva device repositions the chambers. Empty chamber one is returned to its original position and the vacuum fill system begins a new cycle.

By deaerating and compacting the flowable material before filling the flexible container through the use of the vacuum fill system of the present invention, the flowable material is presettled and will not settle during shipment. Thus, the present invention allows for complete utilization of the flexible container, eliminating wasted space and allowing for the shipment of more material without any increase in the container volume. The use of the present invention thus provides numerous advantages over the prior art.

BRIEF DESCRIPTION OF THE DRAWINGS

A more complete understanding of the invention may be had by reference to the following Detailed Description when taken in conjunction with the accompanying Drawings, in which:

FIGS. 1 through 4 demonstrate operation of the vacuum fill system, showing the sequential steps as they occur in each chamber, and wherein:

FIG. 1 is a partial sectional view of the vacuum fill system illustrating its use with semi-bulk containers used for flowable material, and illustrating the filling of chamber one with flowable material before deaerating;

FIG. 2 is a partial sectional view of the vacuum fill system illustrating the deaeration process in chamber one;

FIG. 3 is a partial sectional view of the vacuum fill system illustrating the compacted, deaerated flowable material being released from chamber one; and FIG. 4 is a partial sectional view of the vacuum fill system illustrating compacted, deaerated flowable material inside the flexible container and a new vacuum being created in chamber one;

FIGS. 6 through 9 illustrate an alternate embodiment of the vacuum fill system, wherein:

FIG. 6 is a perspective view of an alternate embodiment of the vacuum fill system illustrating the four vertically-oriented, cylindrically-shaped chambers which rotate counterclockwise in a horizontal plane;

FIG. 7 is a top sectional view of one of the vertically-oriented chambers, illustrating its connection with a vacuum line;

FIG. 8 is a top view of a vertically-oriented, four-chambered container illustrating the cycle as it occurs in each chamber; and FIG. 9 is a partial sectional view of a vertically-oriented, four-chambered container illustrating the filling process in the left chamber and compacted, deaerated flowable material being released from the right chamber.

DETAILED DESCRIPTION OF THE INVENTION

Figure 1:
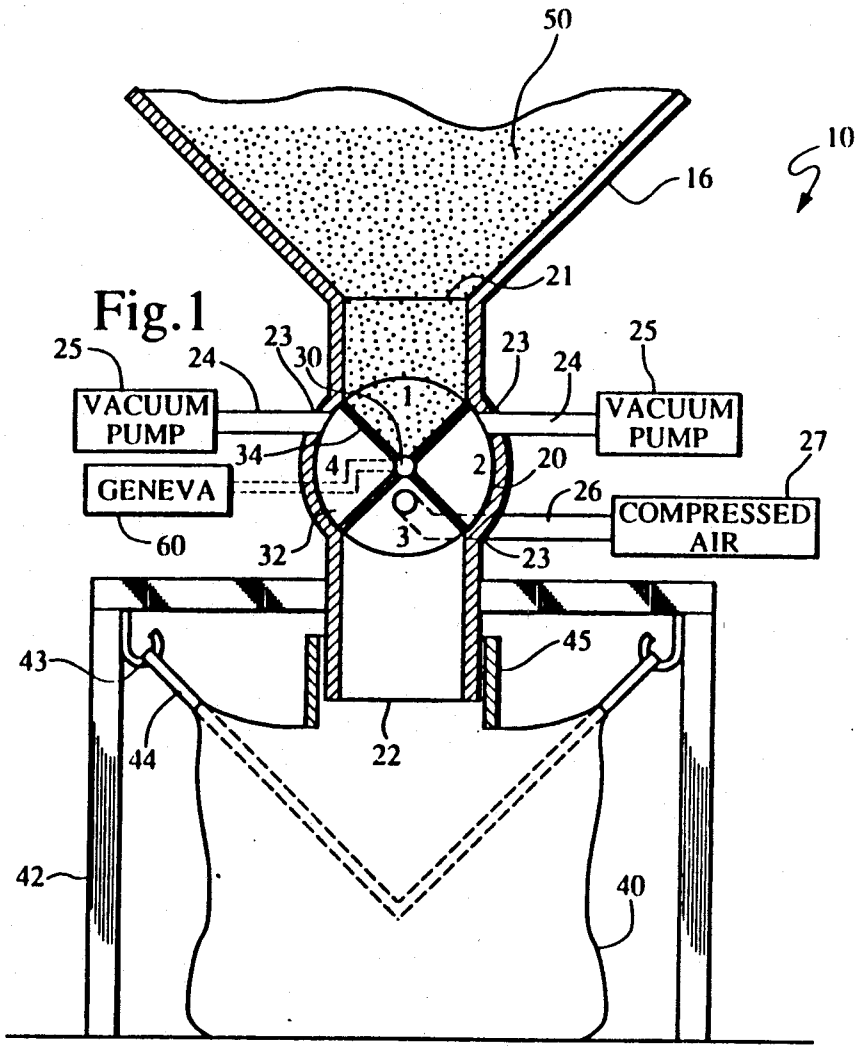

Referring to FIG. 1, there is shown a vacuum fill system 10 incorporating a first embodiment of the present invention. The vacuum fill system 10 has a hollow, cylindrical container 20 enclosing a rotating member 30 attached to a partition 34 which defines four chambers 32 of equal size.

Attached to the first end 21 of the hollow, cylindrical container 20 defining an intake spout is a holding/storage device 16 through which flowable material 50 enters the container 20. The hollow, cylindrical container 20 also has a second end 22 defining a discharge spout through which the compacted, deaerated flowable material 50 exits the container 20.

The hollow, cylindrical container 20 has a plurality of openings 23 into which vacuum lines 24 run. In the preferred embodiment of the invention, there are at least two openings 23 and two vacuum lines 24 running in opposite directions. The two vacuum lines 24 are connected to conventional vacuum pumps 25.

Although any conventional vacuum pump may be utilized with the present invention, the vacuum pump must be capable of pulling a minimum of eighteen (18) inches of mercury during operation. Throughout the remainder of the specification, the term vacuum is used for clarity, it being understood that the term means a partial vacuum of at least eighteen (18) inches of mercury, a total or perfect vacuum being impossible to achieve.

The container 20 may also have an opening 23 connecting an air line 26 to a compressed air source 27.

FIGS. 1 through 4 illustrate the operation of the vacuum fill system of the present invention. Although the vacuum fill system 10, as illustrated in FIGS. 1 through 4, is used in connection with the filling of a semi-bulk container for handling flowable material, it must be understood that the present invention is capable of being utilized with any type of container, no matter how large or small, where it is desired to compact, deaerate and densify the flowable material for packing into a container for shipment and storage.

Initially, a vacuum line 24 to a vacuum pump 25 is open, creating a vacuum in empty chamber one. Air is evacuated through the action of the vacuum pump 25 which draws air from chamber one through the vacuum line 24. Once chamber one has been deaerated, a geneva mechanism 30, which converts rotary motion to intermittent motion, sequentially moves the four chambers 32 in a counterclockwise direction to a position where chamber one is aligned with the holding/storage device 16 and the intake spout 21.

In FIG. 1, chamber one is shown filled with flowable material 50. The flowable material 50 is contained within a conventional holding/storage device 16, such as a hopper. During operation of the vacuum fill system 10, a flexible container 40 is connected to the vacuum fill system 10 through conventional means such as hooks 43 mounted in a frame 42. Support loops 44 on the container 40 are placed over the hooks 43 to suspend the container 40 below the discharge spout 22 of the hollow container 20. A filling tube 45 on the container 40 is placed around the discharge spout 22 comprising the second end of the hollow container 20 to prevent spillage while filling the container 40.

The movement of flowable material 50 into chamber one is controlled either by weight or height level. When the predetermined height or weight is reached, the geneva mechanism 30 sequentially moves the chambers 32 in a counterclockwise direction.

Figure 2:
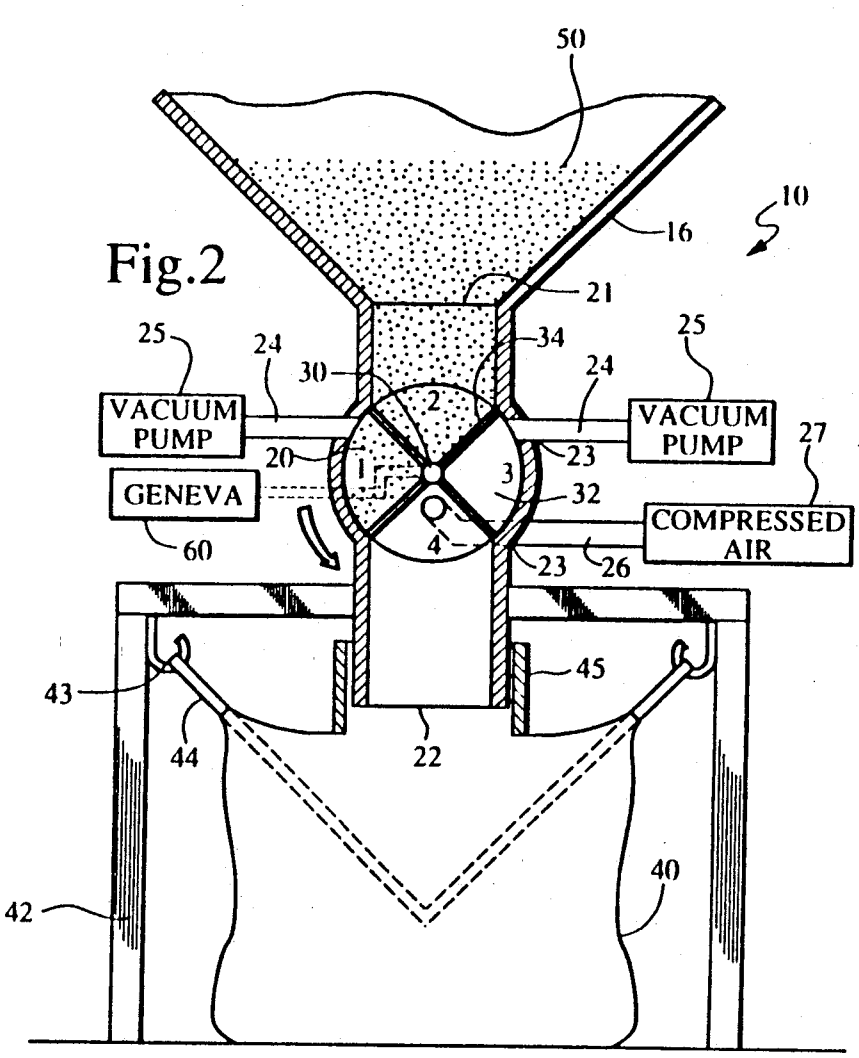

In FIG. 2, chamber two is shown filled with flowable material 50, and the vacuum lines 24 to the vacuum pumps 25 are open, creating vacuums in chambers one and three.

When the air is evacuated from chamber one, the volume of flowable material 50 actually increases slightly as the internal air passes through it and the vacuum is created. Thus, there is actually a volume gain until the chamber 32 is returned to atmospheric pressure.

Once the vacuum in chamber one reaches the level necessary to achieve the desired deaeration of the flowable material 50, chamber two is filled with flowable material 50, and a vacuum is established in empty chamber three, the geneva device 30 repositions the chambers 32.

Figure 3:
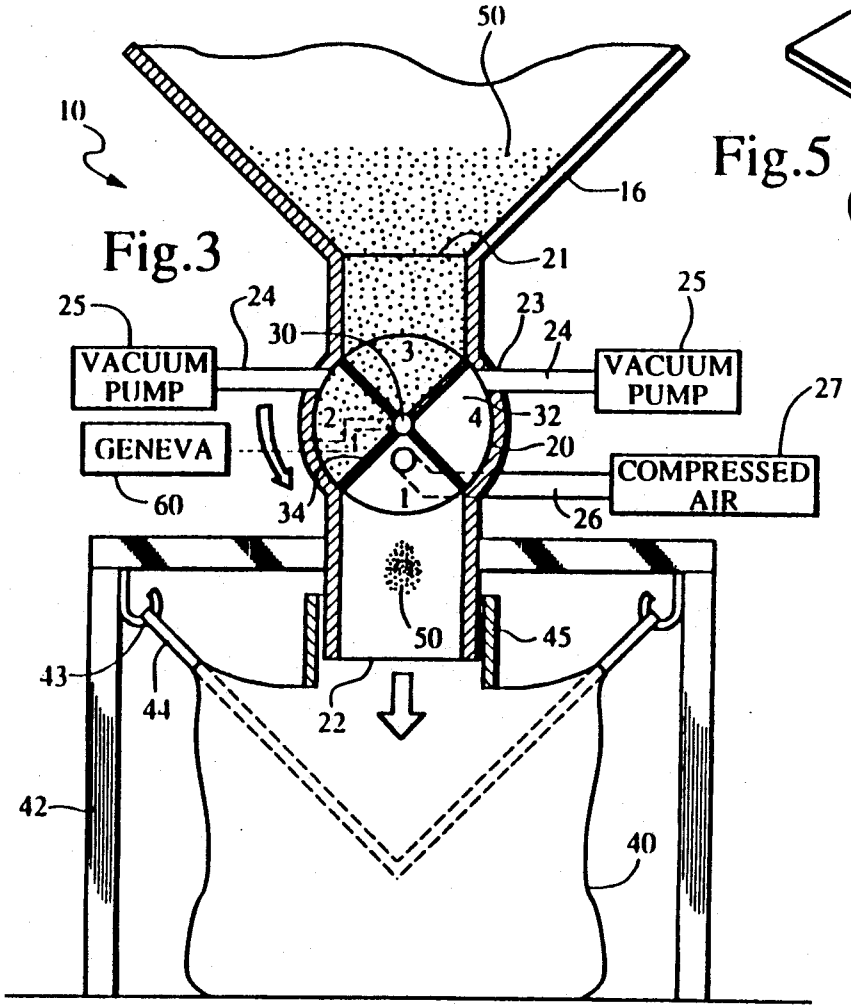

Turning to FIG. 3, the flowable material 50 in chamber one has been deaerated and compacted, and the volume of flowable material 50 is now significantly less than when first introduced into the hollow, cylindrical container 20. Compaction of the flowable material 50 is achieved when chamber one is rotated to the fourth position. This causes the interior of chamber one to return to atmospheric pressure substantially instantaneously, whereby the previously deaerated flowable material 50 is compacted.

Compressed air may be fed through the air line 26 from the compressed air source 27 into chamber one after compaction has occurred. If used, the compressed air functions to eject the compacted, deaerated flowable material 50 from the chamber 32.

The compacted, deaerated flowable material 50 moves as a compact "slug" of material into the flexible container 40. Since the compacted and deaerated flowable material 50 is highly densified and only drops a short distance before entering the flexible container 40, deaeration is avoided.

Figure 4:
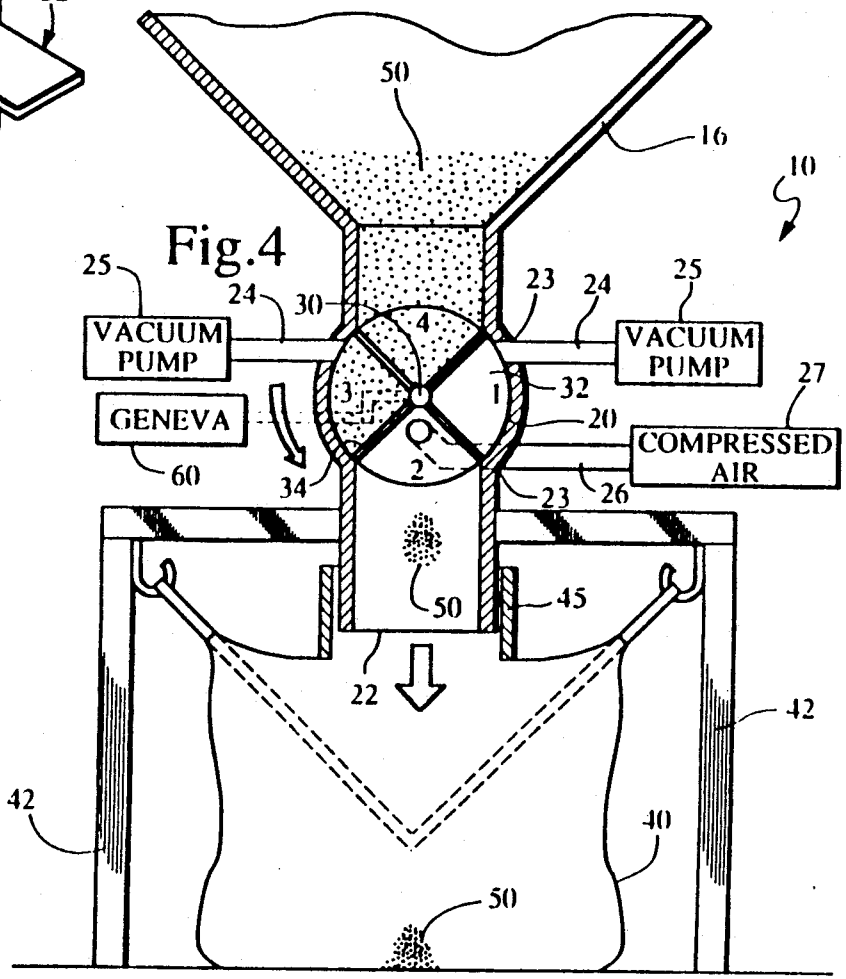

Turning now to FIG. 4, the compacted, deaerated flowable material 50 from chamber one is contained within the flexible container 40. Newly compacted, deaerated flowable material 50 from chamber two drops into the flexible container 40. Chamber one has been returned to the first position and is connected to the vacuum pump 25 through the vacuum line 24.

After the filling of chamber four with flowable material 50 and deaeration of flowable material 50 in chamber three, the geneva device 30 rotates the chambers 32 again, and the chambers are positioned as shown in FIG. 1.

Figure 5:
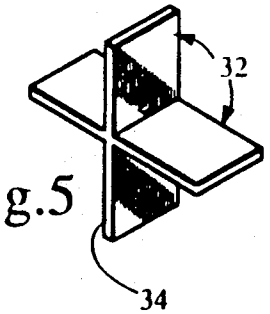
FIG. 5 is a perspective view of the four-walled partition mounted within the cylindrical container to separate the container into four chambers.

In FIG. 5 there is illustrated the four-walled partition 34 which is mounted in the cylindrical container 20 to separate the container 20 into four chambers 32 of equal size.

Figure 6:
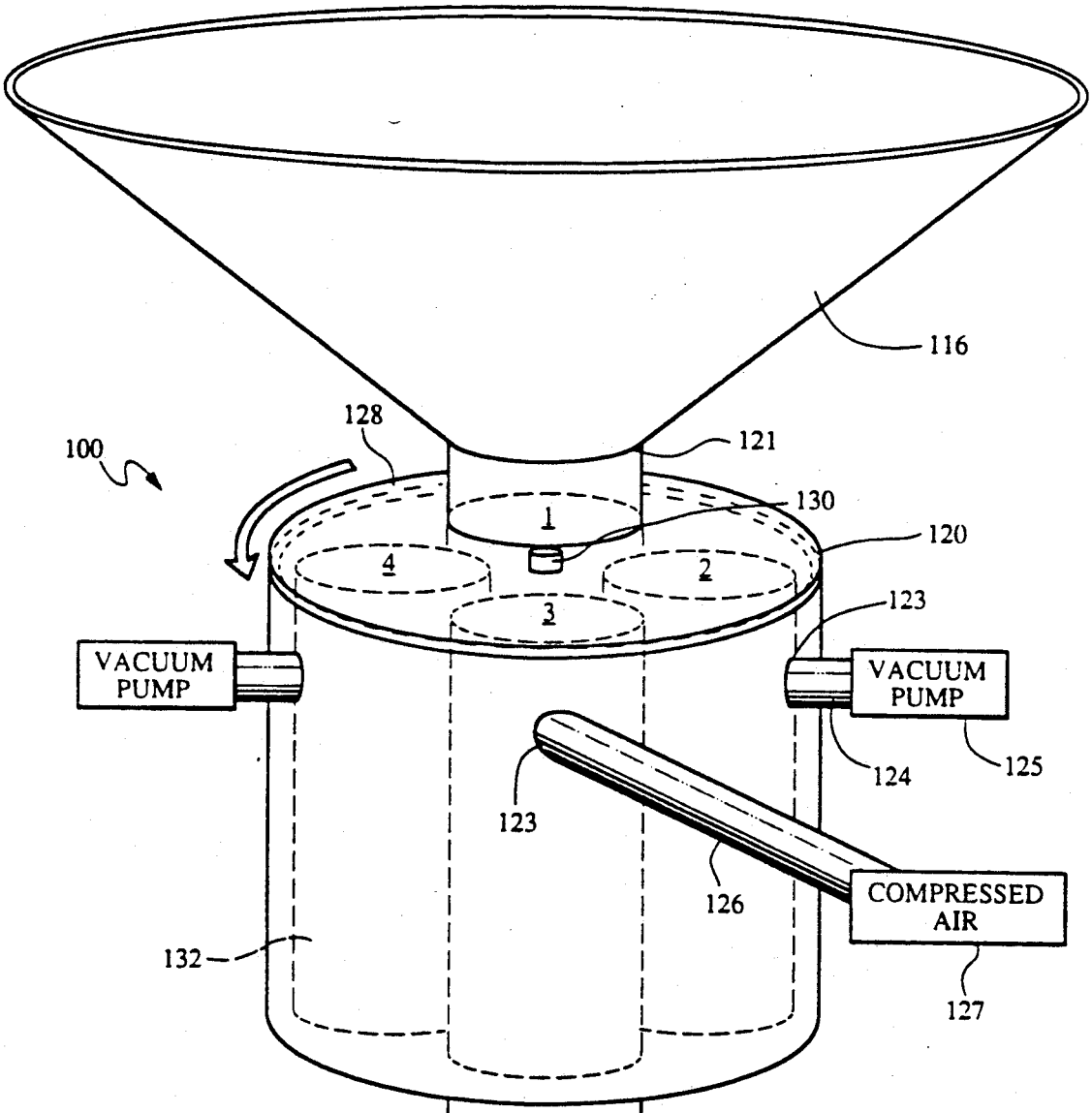

Referring now to FIG. 6, there is illustrated a vacuum fill system 100 comprising a second embodiment of the present invention. The vacuum fill system 100 has a hollow, cylindrically-shaped container 120 with a lid 128, which holds four vertically-oriented, cylindrically-shaped chambers 132. These chambers 132 are positioned 90 degrees apart in the same horizontal plane and rotate counterclockwise. Flowable material moves from the holding/storage device 116 through the intake spout 121 into chamber one. Vacuum lines 124 run from vacuum pumps 125 into openings 123 in the hollow container 120.

As with the first embodiment of the invention, although the vacuum fill system 100 is preferably used in connection with the filling of a flexible container 40 for handling flowable material, it must be understood that the vacuum fill system 100 is capable of being utilized with any type of container, no matter how large or small, where it is desired to compact, deaerate, and densify the flowable material for packing into a container for shipment and storage.

Before flowable material is introduced into the hollow, cylindrical container 120, air is evacuated through the action of the vacuum pump 125 which draws air from chamber one through the vacuum line 124. After a vacuum is created in chamber one, a geneva mechanism 130 sequentially moves the chambers 132 in a counterclockwise direction to a position where empty chamber one is aligned with the holding/storage device 116 and the intake spout 121. Empty chamber one is then filled with flowable material.

When chamber one is filled with flowable material, the geneva mechanism 130 repositions the four chambers 132. A Vacuum is created in chamber one to deaerate the flowable material 150 through the vacuum line 124 connected to the vacuum pump 125.

Once the vacuum reaches the level necessary to achieve the desired deaeration of the flowable material in chamber one, the geneva mechanism 130 rotates the chambers 132 again. As chamber one reaches the fourth position, the interior of the chamber 132 is substantially instantaneously returned to atmospheric pressure, thereby compacting the previously deaerated flowable material. Compressed air may be injected from the compressed air source 127 through the air line 126 into chamber one to eject the compacted, deaerated flowable material as a compact "slug" of material from chamber one into the flexible container.

After the "slug" of flowable material is ejected from chamber one, the geneva mechanism 130 sequentially moves the chambers 132, and the vacuum fill system 100 begins a new cycle.

Figure 7:
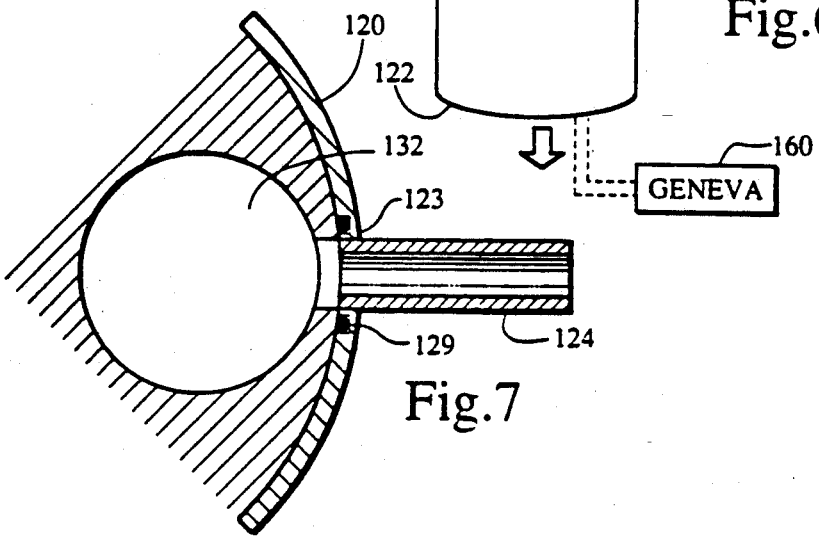

In FIG. 7, one of the vertically-oriented chambers 132 is shown positioned within, the cylindrical, container 120. The vacuum line 124 connects the vacuum pump 125 as shown in FIG. 6, to the container 120 through the opening 123. O-rings 129 provide a seal between the container 120 and the vacuum line 124, and aid in the establishment of a vacuum in the chamber 132.

Figure 8:
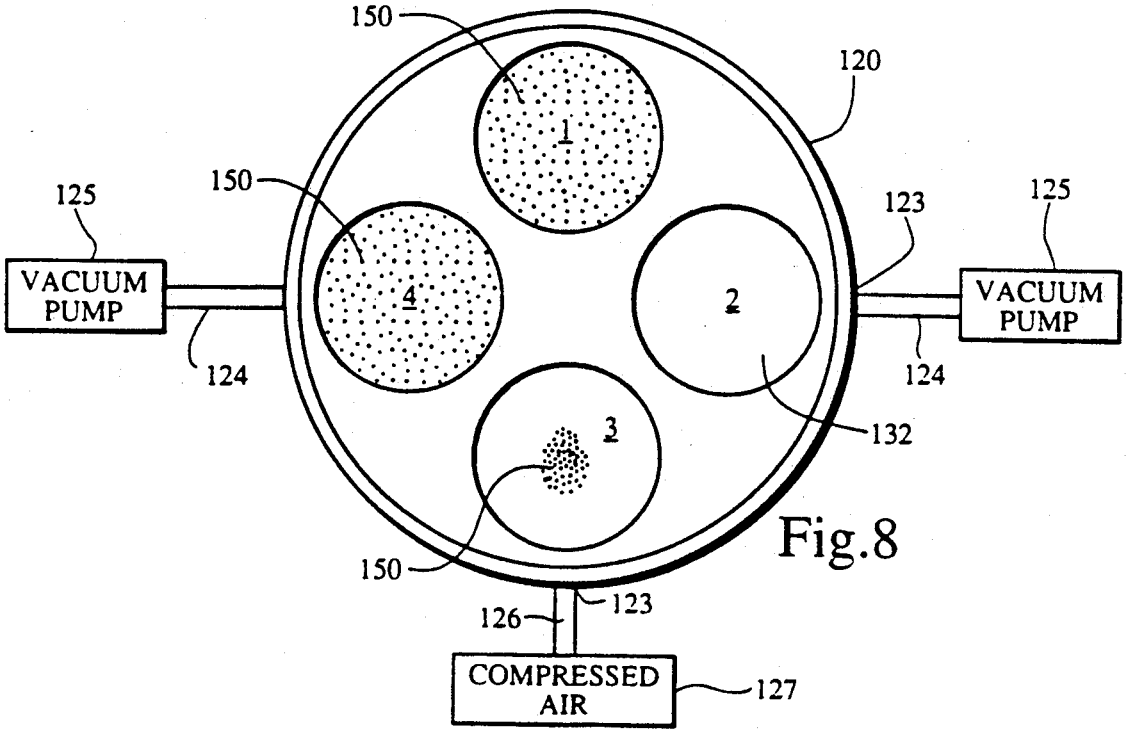

Turning to FIG. 8, the four vertically-oriented chambers 132 are shown within the cylindrical container 120. The filling, deaeration and compaction cycles of the vacuum fill system 100 occur sequentially in each chamber 132.

Figure 9:
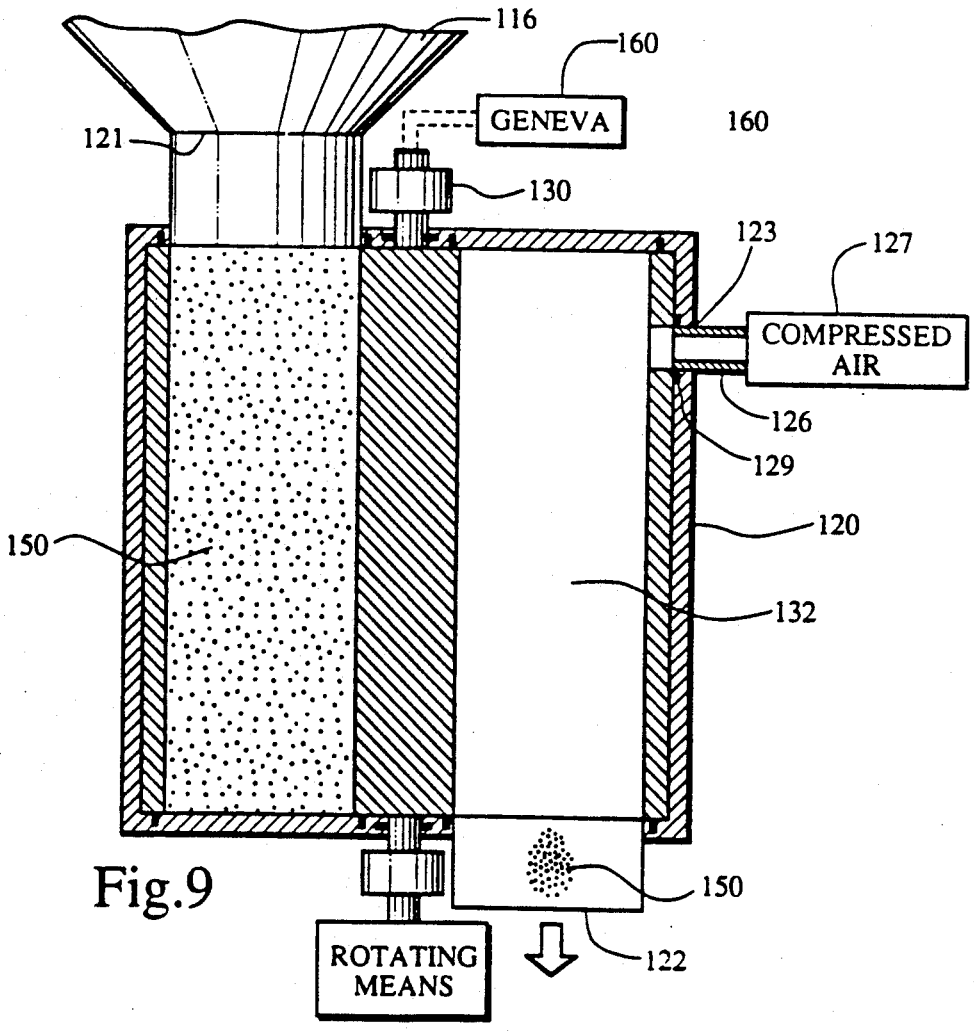

In FIG. 9, there is illustrated the process occurring in two of the four chambers 132. Flowable material 150 contained in the holding/storage device 116 enters the left chamber 132 through the intake spout 121.

After deaeration (not shown), the interior of the right chamber 132 is returned substantially instantaneously to atmospheric pressure, thereby compacting the deaerated flowable material 150. The compacted, deaerated flowable material 150 exits the chamber 132 and drops into a flexible container 140 (not shown).

Compressed air may be used to eject the compacted, deaerated flowable material 150 from the chamber 132. If used, compressed air from the air source 127 moves through the air line 126 into the chamber 132.

Although not shown, it should be understood that the operation of the first and second embodiments of the vacuum fill system 10 and 100 may be performed either manually or automatically through the use of conventional electronic circuitry.

Although preferred embodiments of the present invention have been illustrated in the accompanying Drawings and described in the foregoing Detailed Description, it will be appreciated by those skilled in the art that various modifications and rearrangements of the component parts and elements of the present invention are possible within the scope of the present invention.

OPERATION

Chamber one is aligned with the first zone of the cylindrically-shaped container. Air is evacuated from the chamber, creating a vacuum, through the use of a vacuum line connected to a vacuum pump. The device for sequentially aligning each of the four chambers with each of the four zones repositions the chambers such that chamber one is aligned with the second zone.

Flowable material moves from the holding/storage device through an intake spout into chamber one. When a predetermined level of height or weight of flowable material is reached in chamber one, the device for sequentially aligning each chamber with each zone moves chamber one to a position in alignment with the third zone.

A vacuum is established in chamber one through the use of the vacuum pump and vacuum line for deaerating the flowable material. Thereafter, the geneva mechanism repositions the chambers such that chamber one is aligned with the fourth zone.

Substantially instantaneously, the interior of chamber one is returned to atmospheric pressure for compacting the deaerated flowable material. The compacted, deaerated flowable material drops from chamber one into a flexible container. The device for sequentially aligning each of the chambers with each of the zones repositions the chambers such that chamber one is returned to its original position in alignment with the first zone. The vacuum fill system begins a new cycle.

I claim:

1. A vacuum fill system for deaerating flowable material comprising:

means defining a plurality of chambers;

enclosed, airtight housing means surrounding chamber-defining means and defining a plurality of zones equal in number to the plurality of chambers;

means for sequentially aligning each of the chambers with each of the zones of the housing means;

means for filling each chamber with flowable material when the chamber is aligned with one of the zones;

means for creating a vacuum in each chamber when the chamber is aligned with the next adjacent zone for deaerating the flowable material; and means for thereafter returning the pressure in each chamber to atmospheric pressure substantially instantaneously for compacting the deaerated flowable material.

2. A vacuum fill system for deaerating flowable material comprising:

an enclosed, airtight housing defining four zones of equal size;

means mounted within the housing and comprising four chambers of equal size which rotate about an axis;

a geneva mechanism for sequentially aligning each of the four chambers with each of the four zones;

means for filling each chamber with flowable material when the chamber is aligned with a predetermined one of the zones;

at least one vacuum pump for creating a vacuum in the filled chamber when the filled chamber is subsequently aligned with the next adjacent zone for deaerating the flowable material within the filled chamber; and the interior of each chamber being substantially instantaneously returned to atmospheric pressure when the chamber is aligned with the next adjacent zone to compact the deaerated flowable material therein.

3. A vacuum fill system for deaerating flowable material in accordance with claim 2 having at least two vacuum pumps and at least two vacuum lines connected to at least two chambers for deaerating the flowable material.

4. A vacuum fill system for deaerating flowable material in accordance with claim 2 having means for ejecting the compacted, deaerated flowable material from each chamber.

5. A vacuum fill system for deaerating flowable material in accordance with claim 4 wherein the means for ejecting the compacted, deaerated flowable material from each chamber further comprises at least one air line connected to at least one compressed air source for regulating the flow of compressed air into the chamber.

6. A vacuum fill system for deaerating flowable material comprising:

enclosed, airtight housing defining four zones of equal size;

a four-walled partition mounted within the housing and comprising four chambers of equal size which rotate about a horizontal axis;

a geneva mechanism for sequentially aligning each of the four chambers with each of the four zones;

means for filling each chamber with flowable material when the chamber is aligned with a predetermined one of the zones;

at least one vacuum pump connected t the housing for creating a vacuum in the filled chamber when the chamber is aligned with the n ext adjacent zone for deaerating the flowable material within the chamber;

at least one vacuum line connecting the housing and the vacuum pump;

means for returning the pressure in the chamber filled with deaerated flowable material to atmospheric pressure substantially instantaneously when the chamber is aligned with the next adjacent zone to compact the deaerated flowable material therein.

7. A vacuum fill system for deaerating flowable material in accordance with claim 6 wherein the hollow, cylindrically-shaped container defining four zones of equal size further comprises a horizontally-extending container.

8. A vacuum fill system for deaerating flowable material in accordance with claim 6 wherein the means for filling each chamber with flowable material further comprises an intake spout joining a holding/storage device to the hollow, cylindrically-shaped container.

9. A vacuum fill system for deaerating flowable material comprising:

enclosed, airtight housing defining four zones of equal size;

at least four chambers of equal size mounted within the hollow container which rotate about a vertical axis;

a geneva mechanism for sequentially aligning each of the four chambers with each of the four zones;

means for filling each chamber with flowable material;

at least one vacuum pump connected to the housing for creating a vacuum in each chamber when the chamber is aligned with the next adjacent zone and thereby deaerating the flowable material within the chamber;

at least one vacuum line connecting the housing and the vacuum pump; and the interior of each chamber being substantially instantaneously returned to atmospheric pressure when the chamber is aligned with the next adjacent zone to compact the deaerated flowable material therein.

10. A vacuum fill system for deaerating flowable material in accordance with claim 9 wherein the hollow, cylindrically-shaped container defining four zones of equal size further comprise a vertically-extending container with a lid.

11. A vacuum fill system for deaerating flowable material in accordance with claim 9 wherein the four chambers of equal size mounted within the hollow container further comprise hollow, cylindrically-shaped chambers which are positioned 90 degrees apart in the same plane.

12. A vacuum fill system for deaerating flowable material in accordance with claim 9 wherein the means for filling each chamber with flowable material further comprises an intake spout joining a holding/storage device to the hollow, cylindrically-shaped container.

* * * * *